US011784396B2

(12) United States Patent
Kodama

(10) Patent No.: US 11,784,396 B2
(45) Date of Patent: Oct. 10, 2023

(54) ANTENNA AND WIRELESS EARBUD COMPRISING THE SAME

(71) Applicant: GOERTEK TECHNOLOGY CO., LTD., Qingdao (CN)

(72) Inventor: Kenichiro Kodama, Qingdao (CN)

(73) Assignee: GOERTEK TECHNOLOGY CO. LTD., Qingdao (CN)

( * ) Notice: Subject to any disclaimer, the term of this patent is extended or adjusted under 35 U.S.C. 154(b) by 377 days.

(21) Appl. No.: 17/043,219

(22) PCT Filed: Nov. 22, 2019

(86) PCT No.: PCT/CN2019/120093

§ 371 (c)(1),
(2) Date: Sep. 29, 2020

(87) PCT Pub. No.: WO2021/097783

PCT Pub. Date: May 27, 2021

(65) Prior Publication Data

US 2022/0278441 A1 Sep. 1, 2022

(51) Int. Cl.

| | |
|---|---|
| ***H01Q 1/27*** | (2006.01) |
| ***H01Q 1/38*** | (2006.01) |
| ***H01Q 1/48*** | (2006.01) |

(52) U.S. Cl.
CPC ..... *H01Q 1/273* (2013.01); *H01Q 1/38* (2013.01); *H01Q 1/48* (2013.01)

(58) Field of Classification Search
CPC ..... H01Q 1/243; H01Q 1/273; H01Q 1/38–52
See application file for complete search history.

(56) References Cited

U.S. PATENT DOCUMENTS

| | | | | |
|---|---|---|---|---|
| 6,118,406 | A * | 9/2000 | Josypenko | H01Q 5/378 343/700 MS |
| 6,624,789 | B1 * | 9/2003 | Kangasvieri | H01Q 1/243 343/702 |
| 8,717,245 | B1 | 5/2014 | Krivokapic et al. | |
| 10,516,206 | B2 * | 12/2019 | Riisberg | H01Q 9/0464 |
| 11,276,926 | B2 * | 3/2022 | Yun | H01Q 1/523 |
| 11,637,383 | B2 * | 4/2023 | Hiramatsu | H01Q 9/0414 343/702 |

FOREIGN PATENT DOCUMENTS

| | | | |
|---|---|---|---|
| CN | 205752547 | U | 11/2016 |
| CN | 208386866 | U | 1/2019 |
| CN | 109687108 | A | 4/2019 |
| CN | 208820046 | U | 5/2019 |
| JP | 4512630 | B2 | 7/2010 |

* cited by examiner

*Primary Examiner* — Hasan Islam
(74) *Attorney, Agent, or Firm* — Workman Nydegger

(57) ABSTRACT

An antenna and a wireless earbud are provided. The antenna includes: a metal plate; a first dielectric layer and a second dielectric layer disposed on different areas of the metal plate; a first antenna element isolated from the metal plate and configured to be electrically coupled with a ground terminal; and a second antenna element isolated from the metal plate and configured to be electrically coupled with a feeding terminal. The wireless earbud includes a housing, and at least a part of the housing is a metal plate.

19 Claims, 5 Drawing Sheets

ANTENNA AND WIRELESS EARBUD COMPRISING THE SAME

CROSS-REFERENCE TO RELATED APPLICATIONS

The present application is the US national phase of International Application No. PCT/CN2019/120093, titled "ANTENNA AND WIRELESS EARBUD COMPRISING THE SAME", filed on Nov. 22, 2019, which is incorporated herein by reference in its entirety.

TECHNICAL FIELD

The present disclosure generally relates to an antenna for a wireless earbud and a wireless earbud including the antenna.

BACKGROUND

Nowadays, earbuds, especially wireless earbuds, are necessary electronic accessories of mobile equipments. People pursue earbuds with high performance and high quality as well. Currently, most earbuds utilize plastic chassis as the shell of earbuds considering effects of metal on signal transmission. However, plastic chassis affects the rigidity of the shell of earbuds and looks low quality in appearance. It would therefore be desirable to provide a wireless earbud having high strength shell together with a high antenna performance.

SUMMARY

According to embodiments of the present disclosure, an antenna is provided. The antenna includes: a metal plate; a first antenna element isolated from the metal plate and configured to be electrically coupled with a ground terminal; and a second antenna element isolated from the metal plate and configured to be electrically coupled with a feeding terminal.

In some embodiment, the first antenna element is isolated from the metal plate through a first dielectric layer and the second antenna element is isolated from the metal plate through a second dielectric layer, and the first dielectric layer and the second dielectric layer are disposed on different areas of the metal plate.

In some embodiment, the first dielectric layer and the second dielectric layer are formed integrally.

In some embodiment, the first dielectric layer and the second dielectric layer have a same thickness.

In some embodiment, the first dielectric layer has a thickness varying with an area of the metal plate and ranging from 0.05 mm to 1.0 mm, and/or, the second dielectric layer has a thickness varying with the area of the metal plate and ranging from 0.05 mm to 1.0 mm.

In some embodiment, the first antenna element and the second antenna element are configured side by side along their elongation direction.

In some embodiment, a spacing between the first antenna element and the second antenna element ranges from 0.05 mm to 10 mm.

In some embodiment, one end of the first antenna element electrically coupled with the ground terminal is an end close to the second antenna element, and one end of the second antenna element electrically coupled with the feeding terminal is an end close to the first antenna element.

In some embodiment, the metal plate is made of aluminum or stainless steel. In some embodiment, the first antenna element and/or the second antenna element is an FPC antenna, an LDS antenna or a metal antenna. In some embodiment, the first dielectric layer and the second dielectric layer are made of ABS resin.

In some embodiment, the metal plate constitutes at least a part of a housing of an earbud.

In addition, embodiments of the present disclosure further provide a wireless earbud. The wireless earbud includes a housing, at least a part of the housing is a metal plate; a PCB, accommodated in the housing and provided with a ground terminal and a feeding terminal to transmit RF signal thereon; a first antenna element isolated from the metal plate and configured to be electrically coupled with the ground terminal; and a second antenna element isolated from the metal plate and configured to be electrically coupled with the feeding terminal.

In some embodiment, the first antenna element is isolated from the metal plate through a first dielectric layer and the second antenna element is isolated from the metal plate through a second dielectric layer, and the first dielectric layer and the second dielectric layer are disposed on different areas of the metal plate.

In some embodiment, the first dielectric layer and the second dielectric layer have a same thickness.

In some embodiment, the first dielectric layer has a thickness varying with an area of the metal plate and ranging from 0.05 mm to 1.0 mm, and/or, the second dielectric layer has a thickness varying with the area of the metal plate and ranging from 0.05 mm to 1.0 mm.

In some embodiment, the first antenna element and the second antenna element are configured side by side along their elongation direction, and a spacing between the first antenna element and the second antenna element ranges from 0.05 mm to 10 mm.

In some embodiment, one end of the first antenna element electrically coupled with the ground terminal is an end close to the second antenna element, and one end of the second antenna element electrically coupled with the feeding terminal is an end close to the first antenna element.

In some embodiment, the metal plate is made of aluminum or stainless steel. In some embodiment, the first antenna element and/or the second antenna element is an FPC antenna, an LDS antenna or a metal antenna. In some embodiment the first dielectric layer and the second dielectric layer are made of ABS resin.

In some embodiment, the housing includes a top part farthest to a user in use and an in-ear part, and a first ring-shaped part and a second ring-shaped part connected in sequence between the top part and the in-ear part, and at least one among the top part, the first ring-shaped part and the second ring-shaped part is made of the metal plate.

In some embodiment, the in-ear part is made of ABS resin.

According to some embodiments of the present disclosure, the first antenna element and the second antenna element are located near the metal plate with dielectric layers disposed between the first antenna element and the metal plate, and between the second antenna element and the metal plate. A capacitance coupling can be generated between the first antenna element and the metal plate, and between the second antenna element and the metal plate, which can be used as antenna. That is, the metal plate, the first antenna element, the second antenna element and their capacitive coupling work as an antenna together. Thus, the effect of the metal plate on the performance of the antenna can be decreased, which facilitates the design of the metal plate on an electronic device.

Further, the resonance frequency of the antenna which is affected by the capacitive coupling can be adjusted by adjusting the first and second antenna elements, and the thickness of the dielectric layer easily according to the size of the metal plate. Therefore, the metal plate which constitutes a chassis of an earbud can be designed more flexibly to meet market requirements and esthetic requirements.

BRIEF DESCRIPTION OF THE DRAWINGS

The above and other aspects, features, and advantages of the present disclosure will become more apparent from the following description, taken in conjunction with the accompanying drawings, in which.

DETAILED DESCRIPTION

Figure 1:
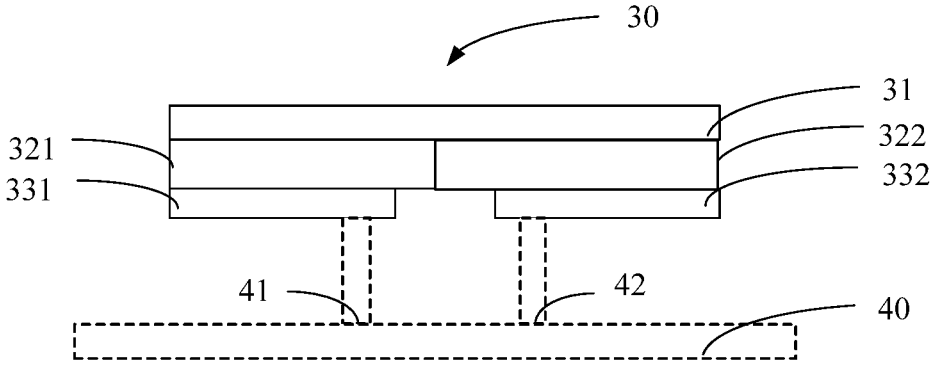
FIG. 1 schematically illustrates a structure of an antenna according to an embodiment of the present disclosure.

Hereinafter, various embodiments of the present disclosure are described with reference to the accompanying drawings. However, it should be understood that there is no intent to limit the present disclosure to the particular forms disclosed herein; rather, the present disclosure is intended to be construed to cover various modifications, equivalents, and/or alternatives of embodiments of the present disclosure. In describing the drawings, similar reference numerals may be used to designate similar elements.

As used herein, the expressions "have", "may have", "include", and "may include" refer to the existence of a corresponding feature (e.g., a numeral, a function, an operation, or an element such as a component), but does not exclude one or more additional features.

The expressions "a first", "a second", "the first", and "the second" used in various embodiments of the present disclosure may modify various components regardless of order and/or importance but is not intended to limit the corresponding components. For example, a first device and a second device indicate different devices although both of them are devices. For example, a first element may be referred to as a second element, and similarly, a second element may be referred to as a first element without departing from the scope of the present disclosure.

It should be understood that when an element (e.g., a first element) is referred to as being (operatively or communicatively) "connected," or "coupled," to another element (e.g., a second element), the element may be directly connected or coupled directly to the other element or any other element (e.g., a third element) may be interposer between them. In contrast, it may be understood that when an element (e.g., a first element) is referred to as being "directly connected," or "directly coupled" to another element (e.g., a second element), there is no element (e.g., a third element) interposed between them.

As described above, antenna performance in conventional technology usually depends on length of a metal plate. However, the size of the metal plate is usually changed because of a device size or some related parts like IC chip, chip resistor, inductor and capacitor. When the length of the metal plate is changed, resonance frequency of the antenna is shifted, which makes it difficult to maintain the antenna performance.

For this purpose, the present disclosure provides an antenna, which can maintain the performance of the antenna even when the size of the metal chassis is changed.

FIG. 1 schematically illustrates a structure of an antenna 30 according to an embodiment of the present disclosure. The antenna 30 includes a metal plate 31, a first antenna element 331 and a second antenna element 332. The first antenna element 331 is isolated from the metal plate 31 and configured to be electrically coupled with a ground terminal. The second antenna element 332 is isolated from the metal plate 31 and configured to be electrically coupled with a feeding terminal.

The antenna 30 further includes a first dielectric layer 321 and a second dielectric layer 322 disposed on different areas of the metal plate 31, the first antenna element 331 is disposed on the first dielectric layer 321, and the second antenna element 332 is disposed on the second dielectric layer 322. Both the first antenna element 331 and the second antenna element 332 are at least partially made of a conductive material, and the first antenna element 331 and the second antenna element 332 are disposed with a spacing on the first dielectric layer 321 and on the second dielectric layer 322 respectively. In some embodiment, the first antenna element 331 has one end to be electrically coupled with a ground terminal 41 on a PCB 40, and the second antenna element 332 has one end to be electrically coupled with a feeding terminal 42 of a RF module on the PCB 40. The PCB 40 does not belong to the antenna and is thus drawn in dotted line.

In some embodiment, the first dielectric layer 321 and the second dielectric layer 322 have a same thickness and connected with each other to form a whole isolation layer. In some embodiment, the first dielectric layer 321 and the second dielectric layer 322 are formed in one step and integrally. In some embodiment, the first dielectric layer 321 and the second dielectric layer 322 has a different thickness.

The first dielectric layer 321 and the second dielectric layer 322 are used to form capacitive coupling, which means the thickness of the dielectric layer has an effect on the capacitance value. Therefore, the thickness of the first dielectric layer 321 and the second dielectric layer 322 may vary with an area of the metal plate in practical design. In some embodiment, the first dielectric layer 321 and the second dielectric layer 322 has a thickness ranging from 0.05 mm to 1.0 mm. In some embodiment, the first dielectric layer 321 and the second dielectric layer 322 are made of ABS resin.

In some embodiment, the first antenna element 331 and the second antenna element 332 are configured side by side along their elongation direction. The one end of the first antenna element 331 which is close to the second antenna element 332 is configured to be electrically coupled with the ground terminal 41, and the one end of the second antenna element 332 which is close to the first antenna element 331 is configured to be electrically coupled with the feeding terminal 42. In some embodiment, the spacing between the first antenna element 331 and the second antenna element 332 (i.e., the spacing between the one end of the first antenna element 331 electrically coupled with the ground terminal 41 and the one end of the second antenna element 332 electrically coupled with the feeding terminal 42) ranges from 0.05 mm to 10 mm.

In some embodiment, the first antenna element 331 and the second antenna element 332 may be formed using deposition.

In some embodiment, the first antenna element 331 and the second antenna element 332 may be an FPC antenna, an LDS antenna or a metal antenna.

The first antenna element 331 and the second antenna element 332 are also made to form capacitive coupling with the metal plate 31, which means the capacitance value is affected by the area of the first antenna element 331 and the second antenna element 332. Therefore, the area of the first antenna element 331 and the second antenna element 332 may vary with an area of the metal plate 31 in practical design.

In some embodiment, the first antenna element 331 and the second antenna element 332 are coupled to the ground terminal and the feeding terminal on the PCB through a pogo-pin or a leaf spring.

In some embodiment, the metal plate 31 is made of aluminum or stainless steel. In some embodiment, the metal plate 31 is at least a part of a housing of a wireless earbud. The PCB is accommodated in the housing of the wireless earbud, and the grounding terminal and the feeding terminal of the RF module are configured on the PCB.

Utilizing a part of metal plate constituting the housing of the earbud as a part of an antenna, the performance of antenna can be adjusted by the dielectric layers and the antenna elements. The industry design can have more flexibility for the housing of the earbud.

Figure 2:
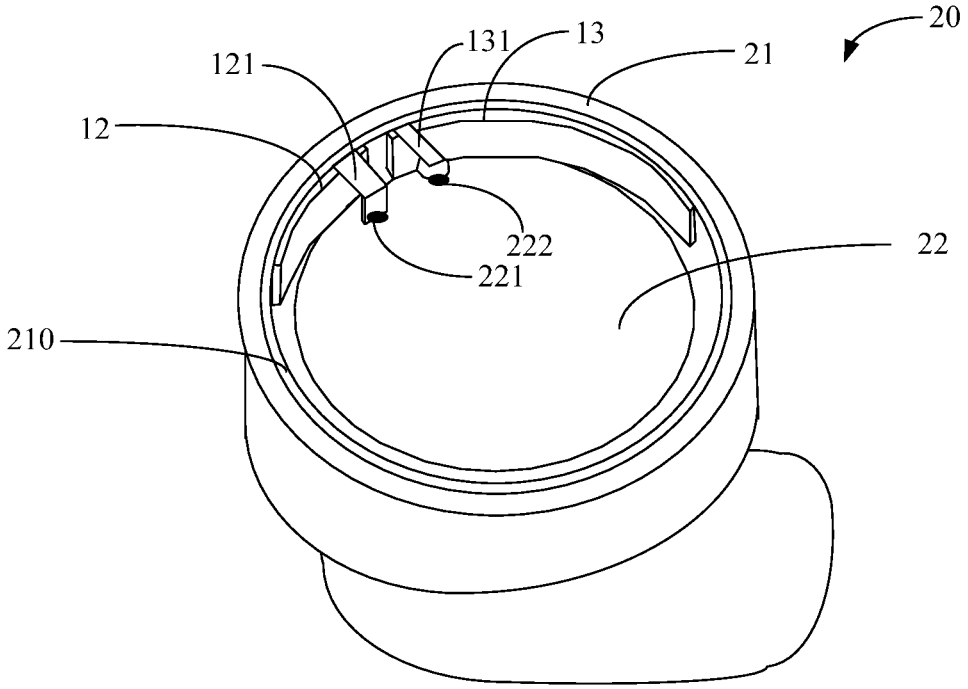
FIG. 2 schematically illustrates a top view of a wireless earbud according to an embodiment of the present disclosure.
Figure 3:
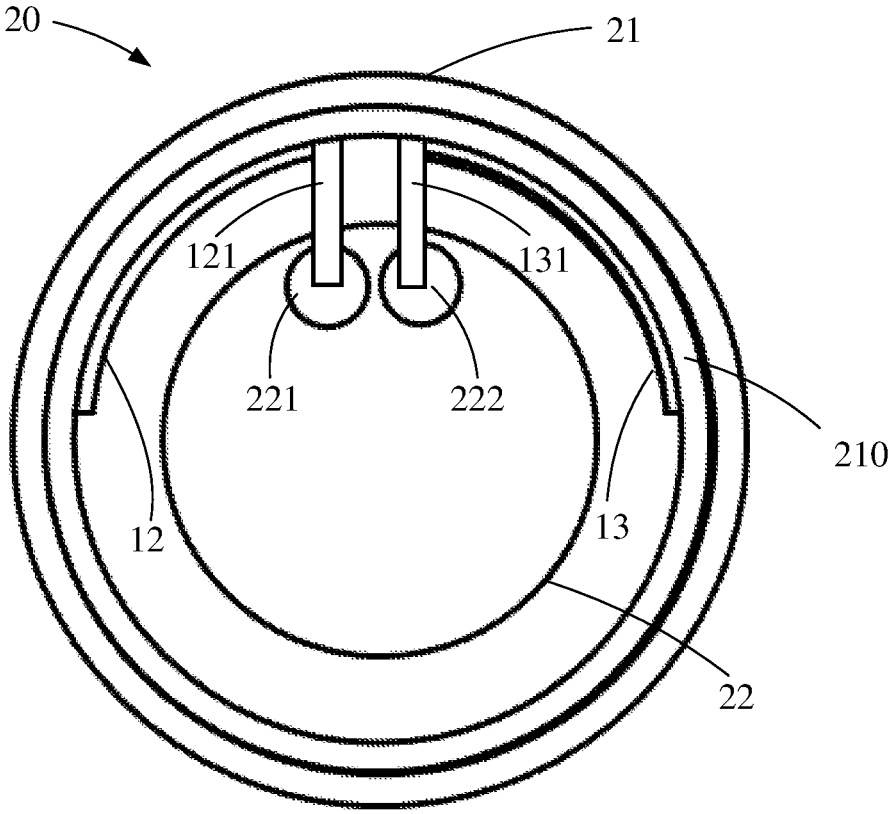
FIG. 3 schematically illustrates a cross-sectional view of the wireless earbud of FIG. 2.

The present disclosure further provides a wireless earbud. FIG. 2 and FIG. 3 schematically illustrate a top view and a cross sectional view of a wireless earbud 20 according to an embodiment of the present disclosure.

According to FIG. 2 and FIG. 3, the wireless earbud 20 includes a housing 21 and a PCB 22 accommodated in the housing 21. There is configured a dielectric layer 210 on the inner surface of the housing 21, and a first antenna element 12 and a second antenna element 13 are configured on the dielectric layer 210 with a spacing. The first antenna element 12 is configured to be grounded, for example, the first antenna element 12 is connected to a grounding terminal 221 of the PCB 22. The second antenna element 13 is configured to transmit and receive a RF signal, for example, the second antenna element 13 is connected to a feeding terminal 222 of the PCB 22.

As shown in FIG. 2, the first antenna element 12 and the second antenna element 13 are arranged perpendicularly to the PCB 22. The first antenna element 12 is connected to the ground terminal 221 through a first connecting member 121, and the second antenna element 13 is connected to the RF module through a second connecting member 131.

In some embodiments, the first antenna element 12 and the second antenna element 13 may have a strip-like shape; in other embodiments, the first antenna element 12 and the second antenna element 13 may have other shapes such as rectangular, square, circular or any other irregular shapes.

As shown in FIGS. 2 and 3, a dielectric layer portion under the first antenna element 12 forms a first dielectric layer, and a dielectric layer portion under the second antenna element 13 forms a second dielectric layer. In other words, the first dielectric layer and the second dielectric layer are formed integrally to form the dielectric layer 210. The first dielectric layer and the second dielectric layer may have a same thickness. In some embodiment, the first dielectric layer and the second dielectric layer may have different thickness, which is not described hereinafter.

In some embodiment, at least a part of the housing of the wireless earbud 20 is made of conductive material, such as a metal plate. The dielectric layer 210 is to generate a capacitive coupling between the housing 21 and the first antenna element 12, and between the housing 21 and the second antenna element 13. The housing 21, the dielectric layer 210, the first antenna element 12 and the second antenna element 13 constitute a radiator of an antenna of the wireless earbud 20 according to the present disclosure.

In some embodiment, the first dielectric layer, i.e., the dielectric layer portion between the housing 21 and the first antenna element 12 has a thickness in a range from 0.05 mm to 1.0 mm.

In some embodiment, the second dielectric layer, i.e., the dielectric layer portion between the housing 21 and the second antenna element 13 has a thickness in a range from 0.05 mm to 1.0 mm.

In some embodiment, the part of the housing of the wireless earbud 20 is made of a conductive material. In some embodiment, the conductive material may be aluminum, stainless steel or any other suitable material.

In some embodiment, the first antenna element 12 and the second antenna element 13 may have the same or different shape, area or material, and each antenna element may be adjusted respectively.

In some embodiment, the first antenna element 12 and/or the second antenna element 13 maybe an FPC antenna, an LDS antenna or a metal antenna.

For example, the first antenna element 12 and the second antenna element 13 are directly formed on the dielectric layer 210 using laser direct structuring (LDS). The dielectric layer 210 may be made of ABS resin due to its high strength, good fertility and easy processing properties.

As described above, a part of the housing of the wireless earbud 20 is made of the metal plate. There is a dielectric layer configured between the part of the housing and the first antenna element 12, and the second antenna element 13. The capacitive coupling between the housing and the first and second antenna elements can work as an antenna.

According to equation (1), $$C=\varepsilon_r*\varepsilon_o*(S/d), \tag{1}$$

wherein C represents capacitive value, $\varepsilon_r$ represents a relative dielectric constant, $\varepsilon_o$ represents an absolute dielectric constant, and $\varepsilon_o=8.854187817\times10^{-12}$ F/m, and S represents the area of the first antenna element or the second antenna element, and d represents the thickness of the dielectric layer.

In one embodiment, the first antenna element 12 has a length of 12 mm and a width of 2.5 mm, and the second antenna element 13 has a length of 15 mm and a width of 2.5 mm. Thus, as for the first antenna element 12, S=12*2.5=30 $mm^2$, $\varepsilon_r$=3, d=0.2 mm, thus C=4 pF; as for the second antenna element 13, S=15*2.5=37.5 $mm^2$, $\varepsilon_r$=3, d=0.7 mm, thus C=1.4 pF.

As it is known, $$f=c/\lambda, \tag{2}$$

wherein f represents Bluetooth frequency, c represents light velocity, λ represents wave length, and the light velocity is 300000 km/s.

When the housing of the wireless earbud is a ring metal, a length L of the antenna is the diameter of the housing. For example, the length L of the antenna is about ¼ of the wave length λ. When the diameter of the housing is 30 mm, the wave length λ is 120 mm. This wave length corresponds to a frequency of 2500 MHz, which is applicable in Bluetooth. However, if the diameter of the metal plate is reduced to 25 mm, the wave length λ is 100 mm, then the frequency is about 3000 MHz. In this case, it needs to decrease resonance frequency to meet frequency of 2500 MHZ. As the resonance frequency is inversely proportional to the capacitance value C, it needs to increase the capacitance value C in order to decrease the resonance frequency.

Therefore, according to equation (1), the coupling area between the housing and the antenna elements should be increased or the thickness of the dielectric layer should be decreased. In this way, the performance of the antenna still can be met by changing the antenna elements and the dielectric layer if the housing is changed in industry design.

Figure 4:
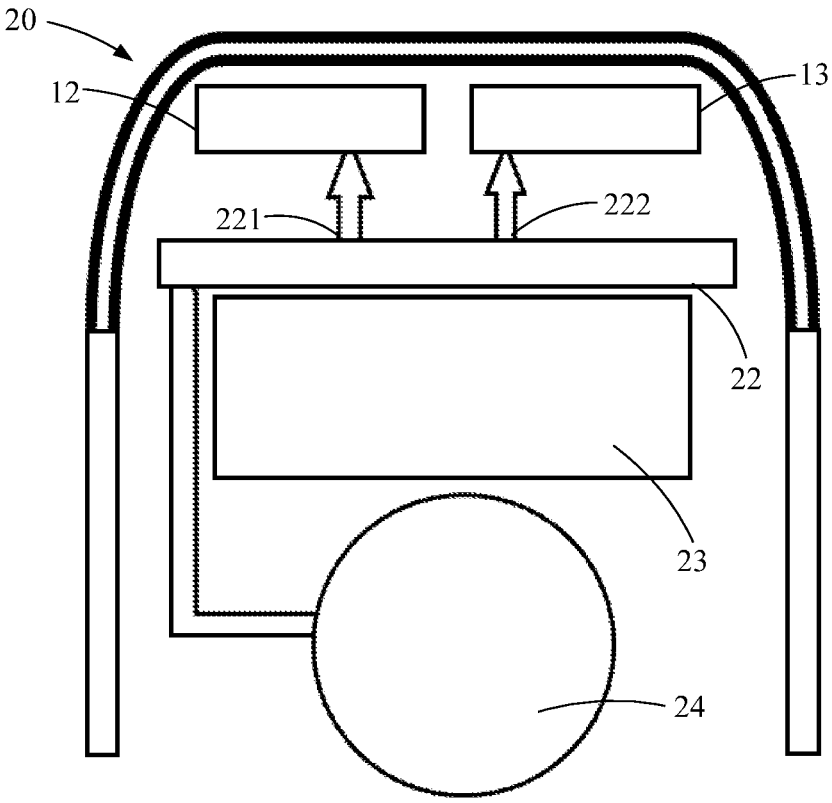
FIG. 4 schematically illustrates an internal structure of a wireless earbud according to an embodiment of the present disclosure, wherein an in-ear part of a housing of the wireless earbud is removed.

FIG. 4 schematically illustrates internal structure of the wireless earbud 20 as shown in FIG. 2 and FIG. 3. The corresponding parts have a same identifier. In some embodiment, the wireless earbud 20 may further include a battery 23 and a speaker 24 accommodated in the housing 21. The battery 23 is configured to supply power to the PCB 22, and the speaker 24 may be connected to the PCB 22 by an FPC (flexible printed circuit). The first antenna element 12 and the second antenna element 13 may be arranged at one side of the PCB 22, while the battery 23 and the speaker 24 may be located at the other side of the PCB 22. For example, the PCB 22 may divide the housing 21 into two parts, an upper part and a lower part. The first antenna element 12 and the second antenna element 13 are located in the upper part, while the battery 23 and the speaker 24 are located in the lower part.

Figure 5:
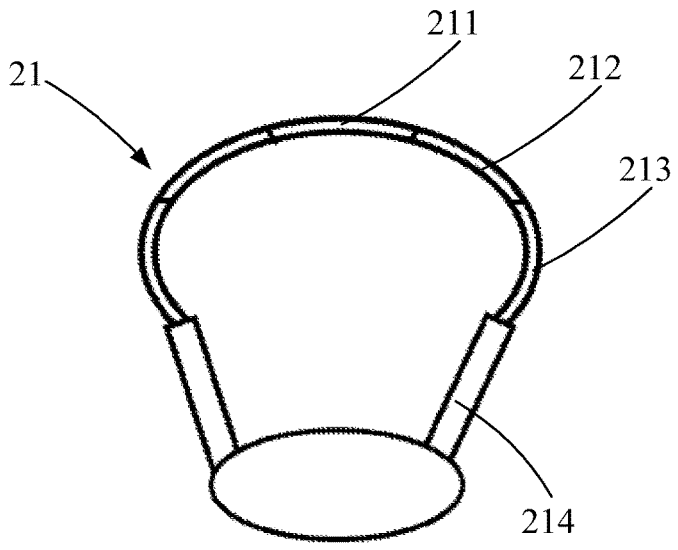
FIG. 5 schematically illustrates a structure of a housing of an earbud according to an embodiment of the present disclosure.

In practical application, the housing of an earbud may be constituted by several separated parts. FIG. 5 schematically illustrates a structure of the housing 21 of the earbud 20 according to an embodiment of the present disclosure. As shown in FIG. 5, the housing 21 includes a top part 211 farthest to a user in use, namely, a center part of the housing 21, an in-ear part 214 for surrounding a sound outlet of the earbud, and a middle part between the top part 211 and the in-ear part 214. The middle part includes a first ring-shaped part 212 and a second ring-shaped part 213 connected in sequence.

In some embodiment, the top part 211 has a symmetrical structure relative to a center of the top part 211. For example, the top part 211 has a circular structure, in order to improve radiation performance of the antenna. In some embodiment, the in-ear part 214 may be made of plastic for comfort. In some embodiment, the in-ear part 214 is made of ABS, or silica gel. The top part 211, the first ring-shaped 212, the second ring part 213 and the in-ear part 214 are connected with each other to form the whole housing 21 for accommodating the PCB 22, the battery 23 and the speaker 24, and other components of the wireless earbud 20.

In some embodiment, the PCB 22 may be disposed close to the top part 211, and the battery 23 and the speaker 24 may be disposed close to the in-ear part 214. When a user wears the wireless earbud, the plane of the top part 211 is substantially parallel to one side of the user's head.

In some embodiment, at least one part among the top part 211, the first ring-shaped part 212, and the second ring-shaped part 213 is made of conductive material to constitute an antenna component to act as the antenna radiator of the wireless earbud. The other part among the top part 211, the first ring-shaped part 212 and the second ring-shaped part 213 which do not constitute the antenna component may be made of conductive material or non-conductive material. However, if a part of them is made of a conductive material but does not constitute the antenna component, it should be isolated from the antenna component if they are disposed adjacently.

Figure 6:
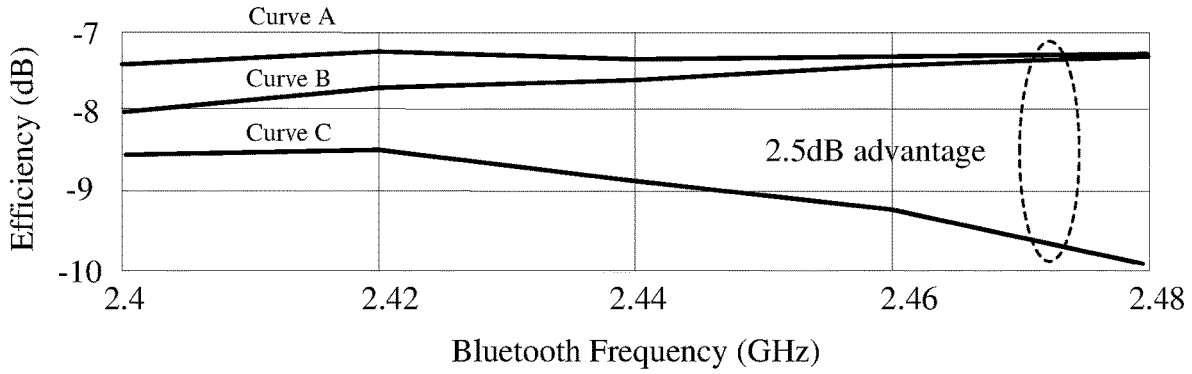
FIG. 6 schematically illustrates a comparison result between an antenna according to an embodiment of the present disclosure and a conventional antenna.

FIG. 6 schematically illustrates a comparison result between an antenna according to an embodiment of the present disclosure and a conventional antenna. In FIG. 6, curve A refers to the antenna efficiency of a first wireless earbud in which both the top part, the first ring-shaped part and the second ring-shaped part are made of metal plate, curve B refers to the antenna efficiency of a second wireless earbud in which the top part is made of plastic, the first ring-shaped part and the second ring-shaped part are made of metal plate, and curve C refers to the antenna efficiency of a third wireless earbud in which whole housing is made of plastic (convention technology). In the first wireless earbud and the second wireless earbud, the first antenna element has a length of 12 mm and a width of 2.5 mm and the first dielectric layer has a thickness of 0.2 mm, and the second antenna element has a length of 15 mm and a width of 2.5 mm and the second dielectric layer has a thickness of 0.7 mm. It can be seen from FIG. 6 that when the frequency is about 2.48 GHz, the antenna efficiency of the first wireless earbud or the second wireless earbud is about 2.5 dB higher than that of the conventional one.

The terms used herein are merely for the purpose of describing certain embodiments of the present disclosure and are not intended to limit the scope of other embodiments. A singular expression may include a plural expression unless they are definitely different in a context. Unless defined otherwise, all terms used herein, have the same meanings as those commonly understood by a person skilled in the art to which the present disclosure pertains. Such terms as those defined in a generally used dictionary may be interpreted to have meanings equal to the contextual meanings in the relevant field of art, and are not intended to be interpreted to have ideal or excessively formal meanings unless clearly defined in the present disclosure. In some cases, even a term defined in the present disclosure should not be interpreted to exclude embodiments of the present disclosure.

Various embodiments disclosed herein are provided merely to easily describe technical details of the present disclosure and to help the understanding of the present disclosure, and are not intended to limit the scope of the present disclosure. Accordingly, it is intended that the present disclosure include all modifications or various other embodiments within the scope of the present disclosure, as defined by the appended claims and their equivalents.

The invention claimed is:

1. An antenna, comprising:

a metal plate, wherein the metal plate constitutes at least a part of a housing of an earbud;

a first antenna element isolated from the metal plate and configured to be electrically coupled with a ground terminal; and a second antenna element isolated from the metal plate and configured to be electrically coupled with a feeding terminal.

2. The antenna according to claim 1, wherein the first antenna element is isolated from the metal plate through a first dielectric layer and the second antenna element is isolated from the metal plate through a second dielectric layer, and the first dielectric layer and the second dielectric layer are disposed on different areas of the metal plate.

3. The antenna according to claim 2, wherein the first dielectric layer and the second dielectric layer are formed integrally.

4. The antenna according to claim 2, wherein the first dielectric layer and the second dielectric layer have a same thickness.

5. The antenna according to claim 2, wherein the first dielectric layer has a thickness varying with an area of the metal plate and ranging from 0.05 mm to 1.0 mm; or, the second dielectric layer has a thickness varying with an area of the metal plate and ranging from 0.05 mm to 1.0 mm; or, the first dielectric layer has a thickness varying with an area of the metal plate and ranging from 0.05 mm to 1.0 mm, and the second dielectric layer has a thickness varying with an area of the metal plate and ranging from 0.05 mm to 1.0 mm.

6. The antenna according to claim 1, wherein the first antenna element and the second antenna element are configured side by side along their elongation direction.

7. The antenna according to claim 1, wherein a spacing between the first antenna element and the second antenna element ranges from 0.05 mm to 10 mm.

8. The antenna according to claim 7, wherein one end of the first antenna element, close to the second antenna element, is electrically coupled with the ground terminal, and one end of the second antenna element, close to the first antenna element, is electrically coupled with the feeding terminal.

9. The antenna according to claim 1, wherein the metal plate is made of aluminum or stainless steel.

10. The antenna according to claim 1, wherein at least one of the first antenna element and the second antenna element is an FPC antenna, an LDS or a metal antenna.

11. The antenna according to claim 2, wherein the first dielectric layer and the second dielectric layer are made of ABS resin.

12. A wireless earbud, comprising:

a housing;

a PCB, accommodated in the housing and provided with a ground terminal and a feeding terminal to transmit RF signal thereon; and an antenna, the antenna comprising a metal plate, wherein the metal plate constitutes at least a part of the housing of the earbud, a first antenna element isolated from the metal plate and configured to be electrically coupled with the ground terminal, and a second antenna element isolated from the metal plate and configured to be electrically coupled with the feeding terminal.

13. The wireless earbud according to claim 12, wherein the first antenna element is isolated from the metal plate through a first dielectric layer and the second antenna element is isolated from the metal plate through a second dielectric layer, and the first dielectric layer and the second dielectric layer are disposed on different areas of the metal plate.

14. The wireless earbud according to claim 13, wherein the first dielectric layer and the second dielectric layer have a same thickness.

15. The wireless earbud according to claim 13, wherein the first dielectric layer has a thickness varying with an area of the metal plate and ranging from 0.05 mm to 1.0 mm; or, the second dielectric layer has a thickness varying with the area of the metal plate and ranging from 0.05 mm to 1.0 mm; or, the first dielectric layer has a thickness varying with an area of the metal plate and ranging from 0.05 mm to 1.0 mm, and the second dielectric layer has a thickness varying with the area of the metal plate and ranging from 0.05 mm to 1.0 mm.

16. The wireless earbud according to claim 12, wherein the first antenna element and the second antenna element are configured side by side along their elongation direction, and a spacing between the first antenna element and the second antenna element ranges from 0.05 mm to 10 mm.

17. The wireless earbud according to claim 12, wherein one end of the first antenna element, close to the second antenna element, is electrically coupled with the ground terminal, and one end of the second antenna element, close to the first antenna element, is electrically coupled with the feeding terminal.

18. The wireless earbud according to claim 12, wherein at least one of the first antenna element and the second antenna element is an FPC antenna, an LDS antenna or a metal antenna.

19. The wireless earbud according to claim 12, wherein the housing comprises a top part farthest to a user in use and an in-ear part, and a first ring-shaped part and a second ring-shaped part connected in sequence between the top part and the in-ear part, and at least one among the top part, the first ring-shaped part and the second ring-shaped part is made of the metal plate.

* * * * *